US006008441A

United States Patent [19]

Steinberger

[11] Patent Number: 6,008,441

[45] Date of Patent: Dec. 28, 1999

[54] CAPO

[76] Inventor: Richard Ned Steinberger, HC 64 Box 090B, Walpole, Me. 04573

[21] Appl. No.: 09/036,709

[22] Filed: Mar. 9, 1998

[51] Int. Cl.[6] ..... G10D 3/00

[52] U.S. Cl. ..... 84/318

[58] Field of Search ..... 84/317, 318, 319

[56] References Cited

U.S. PATENT DOCUMENTS

| | | | |
|---|---|---|---|
| 468,193 | 2/1892 | Dahlman et al. . | |
| 802,537 | 10/1905 | Uren | 24/116 R |
| 4,143,576 | 3/1979 | Nichols et al. | 84/318 |
| 4,149,443 | 4/1979 | Bringe | 84/318 |
| 4,168,648 | 9/1979 | Ronca | 84/318 |
| 4,250,790 | 2/1981 | Shubb et al. | 84/318 |
| 4,324,165 | 4/1982 | Wilkerson | 84/318 |
| 4,583,440 | 4/1986 | Powell | 84/318 |
| 5,117,723 | 6/1992 | Veenschoten | 84/318 |
| 5,492,045 | 2/1996 | Roblee | 84/318 |
| 5,623,110 | 4/1997 | Hoglund et al. | 84/318 |
| 5,792,969 | 8/1998 | Shubb et al. | 84/318 |

FOREIGN PATENT DOCUMENTS

| | | |
|---|---|---|
| 382448 | 10/1923 | Germany . |
| 1755320-A1 | 8/1992 | U.S.S.R. . |

*Primary Examiner*—Robert E. Nappi
*Assistant Examiner*—Wesley Scott Ashton
*Attorney, Agent, or Firm*—Saul Epstein

[57] ABSTRACT

A Capo comprised of two hingedly connected jaws with a torsion spring which urges the jaws toward a closed position, and a hand operated toggle type of linkage operating against said spring to open the Capo. The force needed to be applied to the toggle linkage drops as the Capo is moved toward the open position reducing the effort required to maintain the Capo open while moving it to a new position.

4 Claims, 2 Drawing Sheets

CAPO

BACKGROUND OF THE INVENTION

A Capo is a device for clamping the strings of a guitar or other stringed instrument against the neck of the instrument in order to change their pitch. In the past, Capos have involved screws, cams, and spring loaded clamps for attaching the device to the instrument neck. Spring loaded clamps have become popular because they can be opened and moved to a new position with one hand. However, one problem with prior art spring loaded Capos is that they require considerable hand force to open, and thus can be difficult to keep open as required to position the Capo over the strings. These units have a single pivot point, so that the only way to improve the mechanical advantage is to make the handles very long, which in turn makes the Capo inconvenient and unattractive in use.

It is therefore an object of the present invention to provide a spring loaded Capo which requires relatively little effort to keep open, but yet is small and convenient to use.

SUMMARY OF THE INVENTION

The invented Capo clamps the neck of a stringed instrument between elastomer covered top and bottom jaws using spring force. A hand operated two bar toggle type of linkage is used to open the jaws when it is desired to move or remove the Capo. Moving or removing the Capo can be easily accomplished since, as a result of using a non-linear linkage, the hand force required to open the Capo decreases as the Capo is opened.

DETAILED DESCRIPTION OF THE INVENTION

Figure 1:
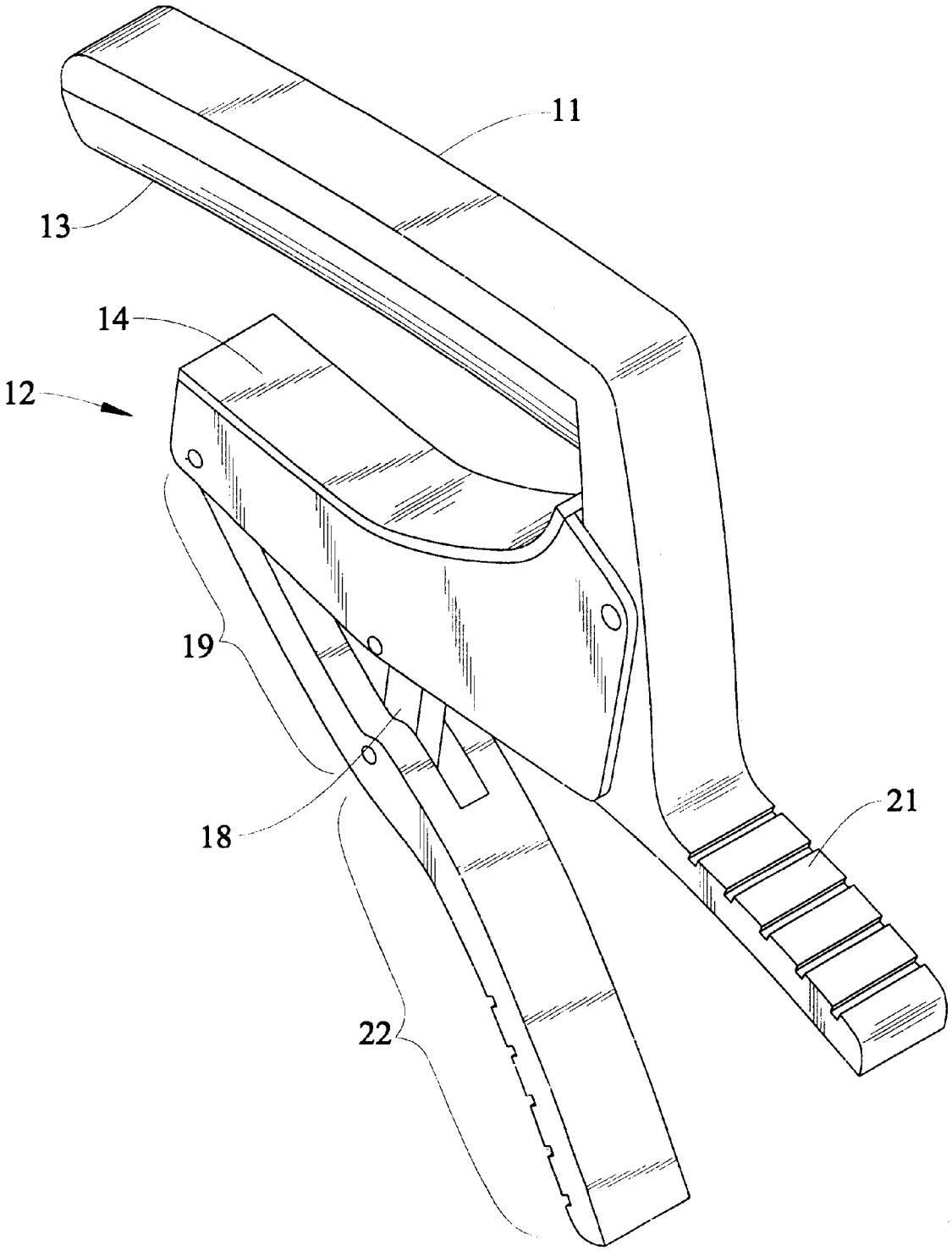
FIG. 1 is a perspective view of the invented Capo.
Figure 2:
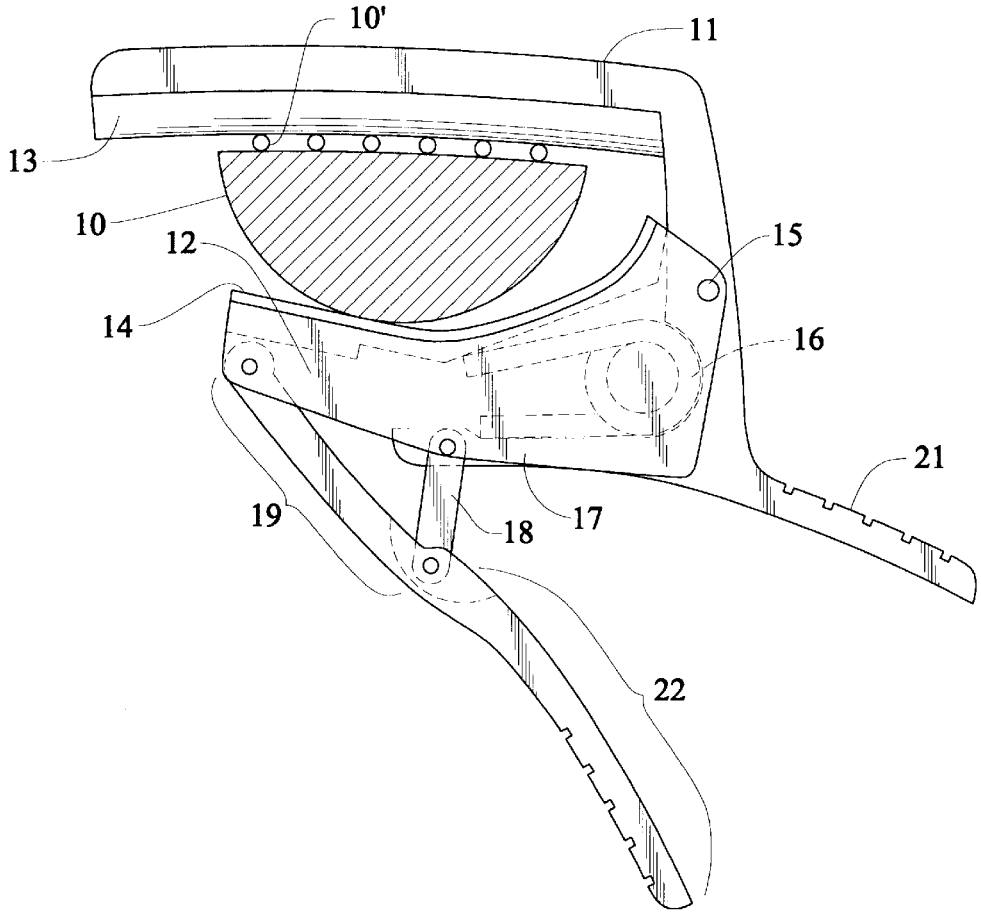
FIG. 2 is a side view of the Capo illustrated in FIG. 1, in closed position.
Figure 3:
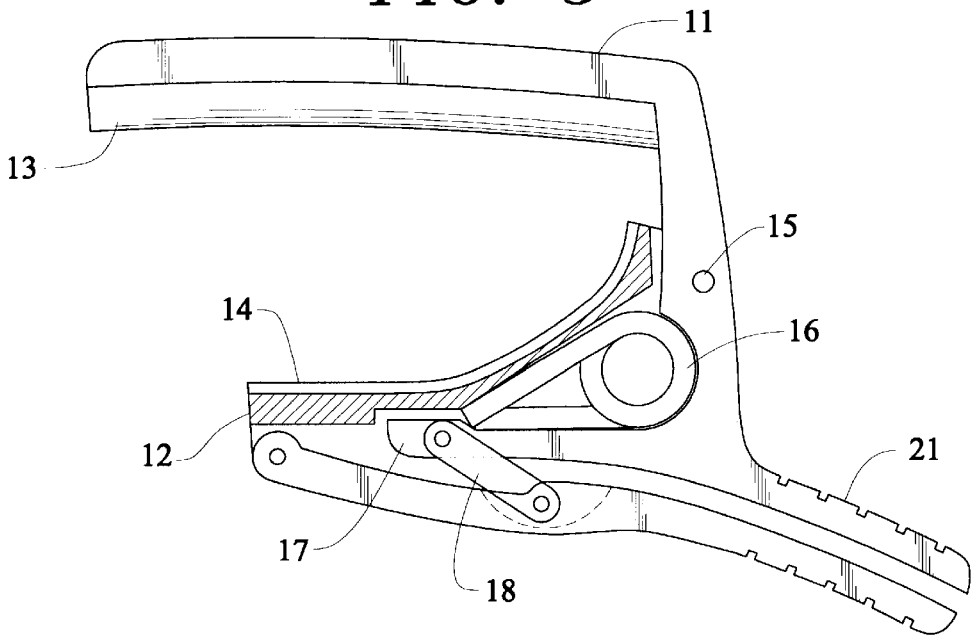
FIG. 3 is a side view of the Capo illustrated in FIG. 1, in open position, with one side of the lower jaw removed, for clarity.

Referring first to FIG. 2, where the neck 10 of a guitar (including strings 10') is shown clamped between top jaw 11 and bottom jaw 12 of a presently preferred embodiment of the invented Capo. The jaws (11 and 12) are both preferably lined with elastomeric pads (13 and 14), pad 13 assuring that all of the strings are clamped to the neck, and both pads preventing the neck from being marred. The bottom jaw 12 wraps partially around, and is pivotally attached to the top jaw at pin 15. Torsion spring 16 bears against the foot 17 of top jaw 11 and the inside of bottom jaw 12, tending to close the jaws, and thereby apply clamping pressure to the guitar neck.

The force to open the jaws is provided by a hand operated two bar toggle type linkage comprised of link 18 and link 19 graspable arm 22. While link 18 and link 19 comprise a toggle type of linkage, in the present application the motion is such that the linkage does not actually toggle, since the jaws are fully open before the two elements which form the toggle are aligned. This type of linkage is used to provide a reducing force requirement as the jaws are opened, but the links do no cross over, i.e., the force does not go to zero and become negative, as in usual toggle applications.

To open the Capo, finger pressure is applied to arm 22 (which projects from link 19) and arm 21 (which projects from jaw 11). As graspable arm 22 approaches arm 21, link 18 rotates to become closer to aligning with graspable arm 22, and the opening force required correspondingly decreases, even while the spring 16 exerts increasing force. Hence, relatively little actuating force is required maintain the Capo open, and the musician can position it on the instrument without having to exert excessive force.

I claim:

1. A Capo having open and closed positions which comprises:

a first jaw including a first graspable arm extending therefrom;

a second jaw hingedly attached to said first jaw;

a spring coupled to said jaws, and urging said jaws toward said closed position;

a non-linear linkage comprised of a series of links coupled to said jaws, and acting between said first jaw and said second jaw; and a second graspable arm extending from one of said links.

2. A Capo as recited in claim 1 wherein said non-linear linkage is comprised of a two bar toggle type linkage.

3. A Capo as recited in claim 1 wherein said second jaw wraps partially around said first jaw and said spring is a torsion spring contained in the space between said first and second jaws.

4. A Capo as recited in claim 1 wherein said jaws are lined with elastomer pads.

* * * * *